US005549030A

United States Patent [19]

Lespron

[11] Patent Number: 5,549,030

[45] Date of Patent: Aug. 27, 1996

[54] AUTOMATIC PISTOL WITH INTEGRAL COMPENSATOR

[75] Inventor: Angel Lespron, Pacoima, Calif.

[73] Assignee: J's Pacific Enterprise, Inc., Pomona, Calif.

[21] Appl. No.: 402,093

[22] Filed: Mar. 10, 1995

[51] Int. Cl.[6] ..... F41A 21/36

[52] U.S. Cl. ..... 89/14.3

[58] Field of Search ..... 89/14.3, 14.05; 42/79

[56] References Cited

U.S. PATENT DOCUMENTS

| | | | |
|---|---|---|---|
| 4,691,614 | 9/1987 | Leffel et al. | 89/14.3 |
| 4,811,648 | 3/1989 | Blackwell et al. | 89/14.3 |
| 5,123,328 | 6/1992 | Schuemann | 89/14.3 |

FOREIGN PATENT DOCUMENTS

| | | | |
|---|---|---|---|
| 512773 | 2/1955 | Italy | 89/14.3 |

OTHER PUBLICATIONS

Metcalf; Top Flight Comp Pistols; Shooting Times; Oct. 1988; pp. 42–50.

Pett; From Pin Guns To Comp Guns; American Rifleman; Nov. 1990; pp. 34–38, 69–70, 82.

*Primary Examiner*—Stephen M. Johnson

*Attorney, Agent, or Firm*—Sheldon & Mak

[57] ABSTRACT

Disclosed is an improved integrally recoil-compensated slide action pistol having a frame, a barrel having a bore on a barrel axis, the bore having a caliber diameter, a feed slide connected to the frame for movement parallel to the barrel axis between open and closed positions, the barrel being substantially enclosed between the slide and the frame in the closed position thereof. The improvement provides lateral front enlargement of the barrel and having a front sight mount; and a pair of compensator ports in fluid communication with the bore that exit at upper shoulder surfaces of the enlargement, the slide being formed for lateral exposure of the enlargement in the closed position. The enlargement is formed flush with the slide in the closed position thereof, the feed slide and the enlargement having symmetrical side surfaces on opposite sides thereof, respective side intersections of the shoulder surfaces with the side surfaces extending on the enlargement parallel to the barrel axis, the exhaust passages extending laterally to the shoulder surfaces, exiting upwardly and outwardly, a side portion of each exhaust passage terminating proximate the corresponding side intersection for obscuring the presence of the exhaust passages.

20 Claims, 1 Drawing Sheet

AUTOMATIC PISTOL WITH INTEGRAL COMPENSATOR

BACKGROUND

The present invention relates to recoil-compensated firearms, and more particularly to a compensator-equipped automatic pistol.

Recoil compensators for firearms are known, and include generally those that apply reaction forces along the barrel axis for limiting axial recoil, and those that apply reaction forces at an angle to the barrel axis for limiting "muzzle jump" or lifting recoil. Lifting recoil is produced as a result of the shooter's grip as well as the center of mass of the firearm being offset (below) the barrel axis such that axial recoil forces produce a muzzle lifting moment when the gun is fired. Axial recoil compensators include muzzle brakes that are typically provided as an accessory that can be threaded onto the muzzle end of the barrel, such devices being provided with radially (and usually rearwardly) extending exhaust passages having polar symmetry about the barrel axis. Muzzle jump or lifting compensators are typically formed integrally with the barrel, having one or more exhaust passages extending vertically through the top of the barrel, the passages being spaced rearwardly behind the muzzle extremity (behind a front sight, if present).

Automatic firearms typically exhibit a degree of recoil compensation in that a portion of the recoil energy is utilized for recocking the trigger mechanism as well as for feeding and chambering a following round. As used herein "automatic firearms" includes semi-automatic and fully automatic arms, the difference being whether separate trigger pulls are required for firing each round. Automatics can be gas or recoil operated, and many automatic pistols have a "slide action" wherein a slide member recoils rearwardly when a round is fired (blowback), the slide member being connected for cocking the trigger mechanism and chambering the next round. The slide member moves rearwardly against spring pressure from a closed position generally surrounding the barrel to an open position that exposes a front portion of the barrel. The barrel itself is typically mounted for more limited axial movement relative to a frame of the firearm, being initially locked to the slide in the closed position thereof, being most closely aligned with the slide in the closed position thereof. In conventional pistols of the type described, front and rear sights are mounted to opposite ends of the slide. A relatively recent development is the use of low-power optical telescopic sights on pistols, such sights being mounted to the frame rather than the slide of slide-action pistols, by brackets that extend above the slide.

A well-known implementation of the above-described slide-action pistol is the venerable U.S. government .45 Colt automatic of 1911, which is famous for its effectiveness and reliability as a personal defense weapon. The legendary character of this firearm is such that modern counterparts are successfully being produced and marketed, and while certain refinements are being incorporated in contemporary models, there is great resistance in the marketplace to easily noticed changes in appearance of the gun. One such feature of the prior art counterparts that is advantageous and desirable is a quasi-cone-shaped mechanical engagement of a forward portion of the barrel with the slide in the closed position thereof for insuring closely repeatable centering of the barrel in the slide without hindering closure of the slide.

The compensators of the prior art generally exhibit one or more of the following disadvantages:

1. They are unsafe in that they can come loose from the barrel, and they can adversely affect accuracy, particularly in a loosened condition;
2. They fail to provide lifting compensation;
3. They reduce the effectiveness of the firearm in that they excessively reduce the muzzle velocity of rounds fired;
4. They adversely affect accuracy in that the shooter's line of sight is obscured by gases discharging upwardly behind the front sight, and barrel enlargements associated with the ports partially block the sighting field of view;
5. They grossly change the appearance of the firearm; and
6. They are incompatible with slide-action pistols wherein the slide movably encloses a front extremity of the barrel, particularly regarding smoothly accurately locating the front extremity relative to the slide in the closed position thereof.

Thus there is a need for a improved recoil compensator that avoids the above disadvantages.

SUMMARY

The present invention meets this need by providing an improved slide action pistol having an integral recoil compensator, the pistol including a frame, a barrel supported relative to the frame and having a bore on a barrel axis, a feed slide slidably connected to the frame for movement parallel to the barrel axis between an open position and a closed position, the barrel being substantially enclosed between the slide and the frame in the closed position thereof. In one aspect of the invention, the improvement includes a lateral front enlargement of the barrel, the slide in the closed position being formed for lateral exposure of the enlargement; and at least one exhaust passage in fluid communication with the bore and extending laterally to an external surface of the enlargement, the exhaust passage being oriented for resisting recoil movement of the barrel when the pistol is fired.

The enlargement can be formed flush with the slide in the closed position thereof. The barrel can have means for supporting a front sight of the pistol. Preferably the pistol includes a pair of the exhaust passages extending upwardly and outwardly on opposite sides of the barrel axis for resisting upward muzzle jump. The exhaust passages can extend outwardly at an angle $\theta$ from a vertical plane including the barrel axis, the angle $\theta$ being between approximately 30° and approximately 50°. Preferably the angle $\theta$ is approximately 40° for a desired combination of barrel jump compensation, structural integrity, and retention of existing visual features of the pistol.

The feed slide and the enlargement can have symmetrical side and shoulder surfaces on opposite sides thereof, the exhaust passages terminating within the shoulder surfaces for obscuring the presence of the exhaust passages. Respective side intersections of the shoulder surfaces with the side surfaces can extend on the enlargement parallel to the barrel axis, a side portion of each exhaust passage terminating proximate the corresponding side intersection for obscuring the presence of the exhaust passages.

The bore can have a caliber diameter, each of the exhaust passages having a length parallel to the barrel axis and a width perpendicular to the barrel axis, the length being greater than the caliber diameter and the width being less than the caliber diameter. Preferably the width of the exhaust passages is between approximately 50% and approximately 80% of the caliber diameter, the length being not less than 150% of the caliber diameter for enhanced effectiveness of the compensator. The caliber diameter can be approximately 0.45 inch, the width is approximately 0.31 inch, and the length is not less than approximately 0.5 inch.

Preferably a cavity is formed within the enlargement of the barrel and outside of the bore, the exhaust passage extending from the cavity for preventing unsymmetrical barrel contact with a projectile being fired from the pistol. The pistol, including the combination of the frame, the barrel and the feed slide, can be shaped for replicating to a U.S. Government .45 caliber automatic of 1911.

DRAWINGS

These and other features, aspects, and advantages of the present invention will become better understood with reference to the following description, appended claims, and accompanying drawings, where:

DESCRIPTION

Figure 1:
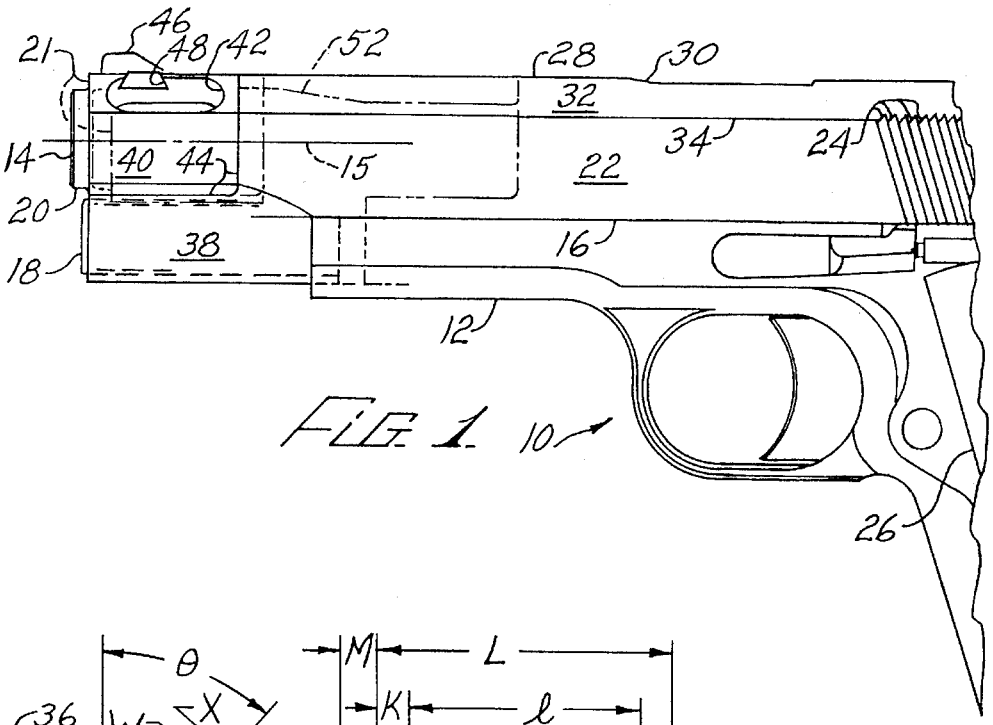
FIG. 1 is a partial side elevational view of a slide-action automatic pistol having an integral compensator according to the present invention.

The present invention is directed to an improved slide-action automatic pistol having an integral compensator. With reference to FIGS. 1–4 of the drawings, a pistol 10 includes a frame 12, a barrel 14 having a barrel axis 15, and a feed slide 16 that is slidable on the frame 12 between a closed position indicated by solid lines in FIG. 1 and an open position as indicated by broken lines, the barrel 14 also having a locked position indicated by solid lines and an unlocked position as indicated by broken lines in FIG. 1. A cylindrical spring retainer 18 is located by the slide 16 under a front extremity of the barrel 14 in the closed position of the slide 16, a conventional slide spring (not shown) extending within the spring retainer 18 for forwardly biasing the slide 16.

The barrel 14 has a conventional rifled bore of caliber C, and can have a cylindrical muzzle extension 20 of length M ahead of a main front barrel surface 21. In these and other respects an exemplary configuration of the pistol 10 is formed to closely resemble traditional construction as shown in the drawings. For example, the feed slide 16 has outwardly facing planar side surfaces 22 that are spaced apart by a spacing S, the side surfaces 22 being smoothly formed ahead of a series of parallel grooves 24 that extend above respective pistol grips 26, and a planar top surface 28 that is interrupted primarily by an ejection port 30. Further, convex shoulder surfaces 32 of the slide 16 make angular side intersections 34 with the side surfaces 22 and corresponding top intersections 36 with the top surface 28. Further, the side surfaces 22 are spaced outwardly from the frame 12, the spring retainer 18 being carried in a quasi-cylindrical bottom portion 38 of the slide 16, the bottom portion 38 retracting partially within the frame 12 as the slide 16 moves rearwardly from the closed position, the bottom portion 38 also extending forwardly to approximately flush with the main front barrel surface 21 in the closed position of the feed slide 16.

According to the present invention, the barrel 14 is formed with an enlargement 40 having a pair of exhaust passages or compensator ports 42, the enlargement 40 being formed with counterparts of the side surfaces 22, the top surface 28, and the shoulder surfaces 32 of the feed slide 16. The slide 16 is notched as indicated at 44 for receiving the enlargement 40 in the closed position of the slide 16, the surfaces 22, 28, and 32 of the enlargement 40 preferably being formed accurately flush with the corresponding surfaces of the slide 16 for preserving the traditional appearance of the pistol 10. Thus to the casual observer, the feed slide 16 appears to include the surfaces 22, 28 and 32 extending forwardly to proximate the main front barrel surface 21. As further described herein, the ports 42 extend upwardly and symmetrically outwardly from the barrel axis 15. Preferably, a front sight 46 is laterally adjustably fixed in a conventional manner on the enlargement 40 between the ports 42 using a dovetail slot 48, the dovetail slot 48 being formed proximate a front extremity of the top surface 28. Thus the front sight 46 appears to be mounted to the feed slide 16 when the slide 16 is in the closed position.

Preferably the ports 42 are elongated parallel to the barrel axis 15 for enhancing an effective passage area thereof while at the same time permitting a relatively narrow opening that is less easily noticed than round openings of the same area, and more completely preserves the structural integrity of the barrel 14. More particularly, the ports 42 are open only within the shoulder surfaces 32, being formed with a length l, a width W, and an end radius r that can be approximately half of the width W (full radius), the width W being confined within the shoulder surface 32. More preferably, a portion of each port 42 intersects the respective shoulder surface 32 along the corresponding side intersection 34 for further obscuring the presence of the ports 42 from casual observation, as well as for spacing the ports for accommodating the front sight 46 therebetween. The intersections of the end radii r with the shoulder surfaces 32 are obscured by the convex shape of the surfaces 32, those intersections being easily perceived as reflections. Moreover, the portions of the ports 42 opposite the side intersections 34 are advantageously obscured by the close proximity of the front sight 46.

Accordingly, length l of the ports 42 is preferably greater than the caliber C, the width W being smaller than the caliber C. More preferably, the width w is between approximately 50% and 80% of the caliber C, and the length l is at least approximately 150% of the caliber C.

Figure 2:
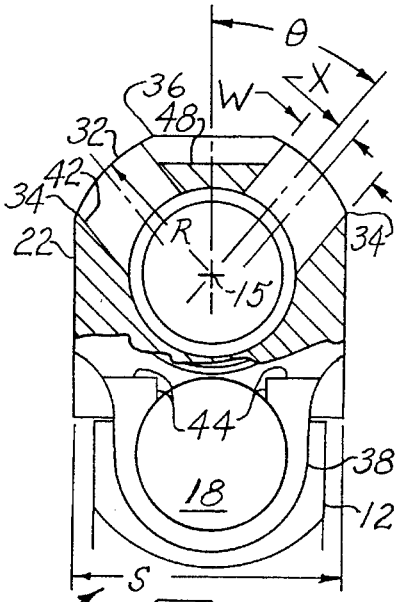
FIG. 2 is a fragmentary sectional front elevational view of the pistol of FIG. 1.

The compensator ports 42 are inclined at an angle θ from vertical as shown in FIG. 2, the angle θ being preferably not more than about 50° for effective compensation of muzzle jump. The angle θ can be reduced to approximately 40°, for example, for enhanced muzzle jump compensation; however, it is desired to maintain ample separation of the ports 42 for avoiding unnecessary weakening of the barrel 14, and for accommodating the front sight 46, as well as for limiting the proximity of upwardly exiting gases to the shooter's line of sight. These seemingly conflicting factors are preferably resolved while maintaining the coincidence with the side intersections 34 by offsetting the ports 42 outwardly by a distance X from alignment with the barrel axis 15. Thus the angle θ can be advantageously selected between approximately 30° and 50°. In a preferred implementation of the pistol 10 that is configured for visually matching the U.S. Government Colt .45 of 1911, the caliber C being 0.45 inch nominally, the spacing S is approximately 0.90 inch, and the shoulder surfaces 32 are formed concentric with the barrel axis 15 at a shoulder radius R of approximately 0.50 inch. In a preferred configuration of the pistol 10, the length l is approximately 0.8 inch, the width W is approximately 0.31 inch, the angle l is approximately 40°, and the offset X is approximately 0.057 inch. Thus each of the ports 42 has an effective area P of $\pi R^2+W(l-2R)=0.076+0.152=0.228$ in$^2$. The nominal area of the caliber C is $0.45^2\pi/4=0.159$ in$^2$, the area P of each port 42 being approximately 44% greater.

The offset X corresponding to coincidence of the outside extremities of the ports 42 with the side intersections 34 is according to the relation, $X=(S/2-RSin(Cos^{-1}(S/2R))Tan\theta)Cos\theta-W/2$. Thus for $\theta=45°$, $X\approx0.017$, and for $\theta=50°$, $X\approx-0.25$. Preferably the offset X is positive for facilitating a smooth, efficient flow of gas through the compensator ports 42, the flow being spaced on opposite sides of the front sight 46. This is because maximum utilization of a pair of exhaust ports for axial recoil compensation occurs when the exhaust ports are located directly opposite the barrel axis (the offset X being zero) for leveling pressure gradients in the region of the barrel axis 15. As the exhaust ports are angled more and more upwardly, they become less effective for axial compensation because of increasing pressure gradients (local depletion) as the ports get closer to each other. Provision of the (positive) offset X according the present invention has the effect of moving the compensator ports 42 farther apart, particularly the portions thereof that are closest to the barrel axis 15. In other words, the gas flows more smoothly outwardly and upwardly when the offset X is positive.

The enlargement 40 of the barrel 14 has a length L that is greater than the length l of the compensator ports 42, each port 42 being spaced behind the main front barrel surface 21 by a distance K, the distance K being preferably approximately half of the difference between the length L and the length E for balancing the structural integrity of the enlargement 40. In the above-described configuration of the pistol 10 corresponding to the 1911 Colt .45, the length L is preferably approximately 1.0 inch for a desired combination of structural integrity without excessively shortening the rifled bore of the barrel 14, the distance K being preferably approximately 0.10 inch.

The barrel 14 is further formed with a cylindrical relief cavity 50 having a diameter D concentric with the barrel axis 15 and within the enlargement 40 for preventing harmful non-symmetrical mechanical engagement of a projectile being fired from the pistol 10 with the barrel 14 proximate the compensator ports 42. Also, a front portion of the barrel 14 ahead of the relief cavity 50 is formed with an exit diameter E that is slightly greater than the caliber C for avoiding contact between the projectile and the barrel subsequent to entry thereof within the cavity 50, the exit diameter E being only slightly greater than the caliber C for inducing an effective pressure flow of gas from the ports 42 upon firing of the pistol 10. In the exemplary and preferred configuration of the pistol 10 conforming to the 1911 Colt .45 outline, the relief cavity 50 has a length B that is approximately 0.84 inch, slightly greater than the length l of the ports 42, the diameter D being approximately 0.55 inch, the exit diameter E being approximately 0.47 inch. The cavity 50 is spaced behind a front extremity of the barrel extension 20 by a distance A that is greater than the distance M by approximately the distance K for symmetrically spacing the ports 42 axially slightly forwardly of the intersection of the relief cavity 50 with the rifled bore of the barrel 14, thereby insuring that the ports 42 do not form an irregular interruption of the caliber C that would adversely affect accuracy of the pistol 10. Thus with the distance M being approximately 0.12 inch, the distance A can be approximately 0.22 inch.

Figure 3:
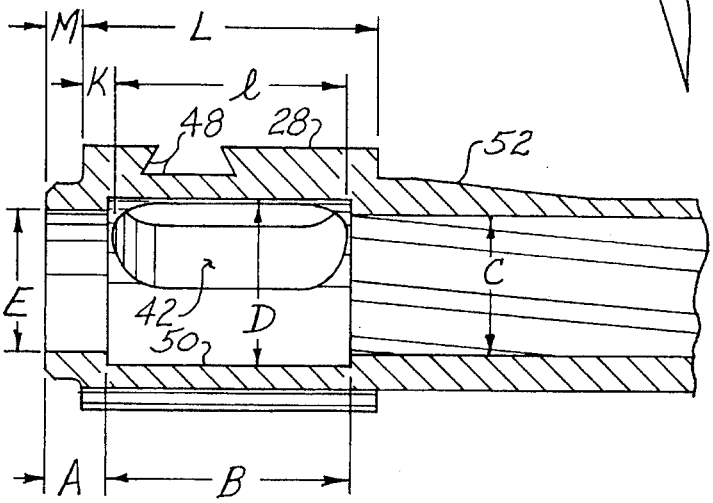
FIG. 3 is a lateral sectional elevational view of a barrel portion of the pistol of FIG. 1.
Figure 4:
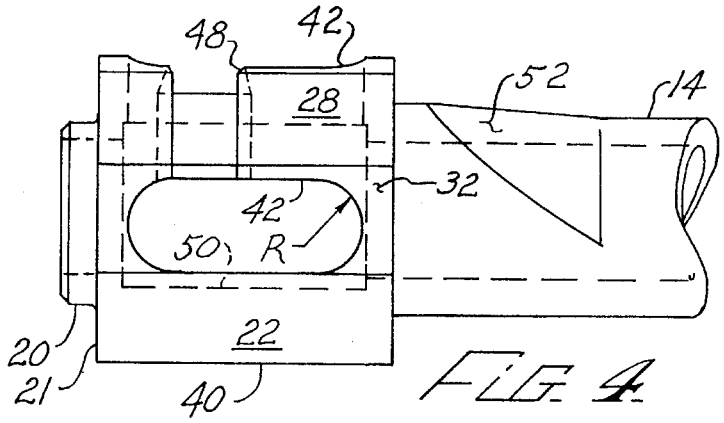
FIG. 4 is a left side oblique view of the barrel portion of FIG. 3.

The present invention can be advantageously applied to a shortened counterpart of the pistol 10 as described above. For example, in a configuration of the pistol 10 having the barrel 14 shortened by 1.0 inch relative to the 1911 Colt .45 but otherwise corresponding thereto, the length E of the ports 42 can be reduced to approximately 0.55 inch while retaining significant effectiveness compensating against muzzle jump. Correspondingly, the length L can be approximately 0.75 inch, and the length B can be approximately 0.57 inch, the other dimensions remaining unchanged. Also, the horizontal portion of the notch 44 that is formed in the slide 16 can be raised from approximately 0.35 inch below the barrel axis 15 as shown in FIGS. 1–3 (approximately level with the top of the spring retainer 18 excepting an arch-shaped extension extending in proximate cylindrical contact with the retainer 18 as shown in FIG. 2) to approximately 0.065 inch (excepting a U-shaped portion forming lower extremities of the barrel extension 20 and the relief cavity 50).

As further shown in the drawings, the barrel 14 is preferably formed with a tapering engagement portion 52 that is located behind the enlargement 40 for smoothly guiding the barrel 14 into locating engagement with the feed slide 16 during movement thereof to the closed position. The engagement portion 52 is located slightly rearwardly of the enlargement 40 for gradually moving a front portion of the barrel 14 into alignment with the feed slide 16 as the slide 16 moves to the closed position. It will be understood that movement of the slide 16 between the open and closed positions produces slight vertical movements of the barrel 14 for engagement thereof with one or more locking bosses (not shown) that are formed in a conventional manner in the feed slide 16, thereby giving rise to the need for repositioning the barrel into alignment with the slide 16 as a round is being chambered by the slide 16. Accordingly, the pistol 10 of the present invention combines an integral muzzle jump compensator in a replica 1911 Colt .45 automatic, the compensator being particularly effective without interfering with a shooter's line of sight and without substantially altering the appearance of the pistol.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. In a slide action pistol including a frame a barrel supported relative to the frame and having a bore on a barrel axis, a feed slide slidably connected with the frame for movement parallel to the barrel axis between an open position and a closed position, the barrel being substantially enclosed between the slide and the frame in the closed position thereof, a springholder portion of the slide in the closed position extending under the barrel to proximate a main front surface of the barrel for enclosing a slide spring of the pistol, the improvement comprising:

(a) a lateral enlargement integrally formed with a front extremity portion of the barrel, the slide being formed for lateral exposure of the enlargement in the closed position, the springholder portion of the slide extending under the enlargement in the closed position; and (b) at least one exhaust passage in fluid communication with the bore, and extending laterally to an external surface of the enlargement, the at least one exhaust passage being oriented for resisting recoil movement of the barrel when the pistol is fired.

2. In the pistol of claim 1, the improvement further comprising the enlargement being formed flush with the slide in the closed position thereof.

3. In the pistol of claim 1, the improvement further comprising the barrel having means for supporting a front sight of the pistol.

4. In the pistol of claim 1, the improvement further comprising the at least one exhaust passage including a pair of exhaust passages extending upwardly and outwardly on opposite sides of the barrel axis for resisting upward muzzle jump.

5. In the pistol of claim 4, the improvement further comprising the exhaust passages of the pair extending outwardly at an angle θ from a vertical plane including the barrel axis, the angle θ being between approximately 30° and approximately 50°.

6. In the pistol of claim 5, the improvement further comprising the angle θ being approximately 40°.

7. In the pistol of claim 4, wherein the feed slide and the enlargement have symmetrical side and shoulder surfaces on opposite sides thereof, the improvement further comprising the exhaust passages terminating within the shoulder surfaces of the enlargement for obscuring the presence of the exhaust passages.

8. In the pistol of claim 1, the improvement further comprising a cavity formed within the enlargement of the barrel and outside of the bore, the exhaust passage extending from the cavity.

9. In a slide action pistol including a frame, a barrel supported relative to the frame and having a bore on a barrel axis, the bore having a caliber diameter, a feed slide slidably connected to the frame for movement parallel to the barrel axis between an open position and a closed position, the barrel being substantially enclosed between the slide and the frame in the closed position thereof, the improvement comprising:

(a) a lateral enlargement integrally formed with a front extremity portion of the barrel, the slide being formed for lateral exposure of the enlargement in the closed position; and (b) pair of exhaust passages in fluid communication with the bore and extending laterally to an external surface of the enlargement the exhaust passages each having a length parallel to the barrel axis and a width perpendicular to the barrel axis, the length being greater than the caliber diameter and the width being less than the caliber diameter, the exhaust passages being oriented for resisting recoil movement of the barrel when the pistol is fired, the width of the exhaust passages being between approximately 50% and approximately 80% of the caliber diameter, the length being not less than 150% of the caliber diameter.

10. In the pistol of claim 9, wherein the caliber diameter is approximately 0.45 inch, the improvement further comprising the width being approximately 0.31 inch, and the length being not less than approximately 0.5 inch.

11. In the pistol of claim 4, wherein the bore has a caliber diameter, the improvement further comprising each of the exhaust passages of the pair having a length parallel to the barrel axis and a width perpendicular to the barrel axis, the length being greater than the caliber diameter and the width being less than the caliber diameter.

12. In the pistol of claim 1, wherein the pistol including the combination of the frame, the barrel and the feed slide, is shaped corresponding to a U. S. Government .45 caliber automatic of 1911, the improvement further comprising the combination of the enlargement of the barrel and the portion of the slide extending under the enlargement having the corresponding shape.

13. In a slide action pistol including a frame, a barrel supported relative to the frame and having a bore on a barrel axis, a feed slide slidably connected to the frame for movement parallel to the barrel axis between an open position and a closed position, the barrel being substantially enclosed between the slide and the frame in the closed position thereof the feed slide and a lateral enlargement having symmetrical side and shoulder surfaces on opposite sides thereof, respective side intersections of the shoulder surfaces with the side surfaces extending on the enlargement parallel to the barrel axis, the improvement comprising:

(a) the lateral enlargement integrally formed with a front extremity portion of the barrel the slide being formed for lateral exposure of the enlargement in the closed position; and (b) pair of exhaust passages in fluid communication with the bore, and extending laterally to an external surface of the enlargement the exhaust passages being oriented for resisting recoil movement of the barrel when the pistol is fired, the exhaust passages terminating within the shoulder surfaces for obscuring the presence of the exhaust passages, a portion of each exhaust passage terminating along the corresponding side intersection for further obscuring the presence of the exhaust passages.

14. A barrel-slide combination for a slide action pistol including a frame, the combination comprising:

(a) a barrel having a bore on a barrel axis and means for supporting the barrel relative to the frame;

(b) a lateral enlargement integrally formed with a front extremity portion of the barrel and having an outside contour;

(c) a feed slide slidably connectable to the frame for movement parallel to the barrel axis between an open position and a closed position for feeding and chambering successive rounds, a springholder portion of the slide extending forwardly under the enlargement for holding a slide spring, the portion of the barrel behind the enlargement being substantially enclosed between the slide and the frame in the closed position thereof with the outside contour of the enlargement being exposed above the springholder portion when the combination is assembled with the frame;

(d) a cavity formed within the enlargement of the barrel and outside of the bore; and (e) at least one exhaust passage formed in the enlargement in fluid communication with the cavity and extending laterally to the outside contour of the enlargement, the exhaust passage being oriented for resisting recoil movement of the barrel when the pistol is fired.

15. The combination of claim 14, further comprising the enlargement being formed flush with the slide in the closed position thereof.

16. The combination of claim 14, further comprising the enlargement of the barrel having sight means for supporting a front sight of the pistol, the at least one exhaust passage including a pair of exhaust passages extending upwardly and outwardly on opposite sides of the sight means for resisting upward muzzle jump.

17. The combination of claim 16, further comprising the pair of exhaust passages extending outwardly at an angle θ from a vertical plane including the barrel axis, the angle θ being approximately 40°.

18. The combination of claim 16, wherein the feed slide and the enlargement have symmetrical side and shoulder surfaces on opposite sides thereof, and the exhaust passages terminate within the shoulder surfaces of the enlargement, a portion of each exhaust passage of the pair terminating along a corresponding side intersection for obscuring the presence of the exhaust passages.

19. The combination of claim 15, wherein the bore has a caliber diameter, further comprising each of the exhaust passages of the pair having a length parallel to the barrel axis and a width perpendicular to the barrel axis, the length being greater than the caliber diameter and the width being less than the caliber diameter.

20. The combination of claim 19, wherein the bore has a caliber diameter, further comprising each of the exhaust passages of the pair having a length parallel to the barrel axis and a width perpendicular to the barrel axis, the length being greater than the caliber diameter and the width being less than the caliber diameter.

* * * * *